US005271109A

United States Patent [19]

Markel et al.

[11] Patent Number: 5,271,109

[45] Date of Patent: Dec. 21, 1993

[54] CONVERTIBLE SOFA-BED

[75] Inventors: David I. Markel; William Leftwich, both of Elkhart, Ind.

[73] Assignee: Voyager, Inc., Elkhart, Ind.

[21] Appl. No.: 944,411

[22] Filed: Sep. 14, 1992

[51] Int. Cl.[5] ..... A47C 17/04; A47C 17/16

[52] U.S. Cl. ..... 5/37.1; 5/47

[58] Field of Search ..... 5/37.1, 47, 118

[56] References Cited

U.S. PATENT DOCUMENTS 2,745,467 5/1956 Vale ..... 5/37.1
3,634,893 1/1972 Hern et al. ..... 5/37.1
4,168,860 9/1979 Garza et al. ..... 5/47
4,563,784 1/1986 Shrock et al. ..... 5/37.1
4,731,888 3/1988 Bridges ..... 5/37.1
4,756,034 7/1988 Stewart ..... 5/37.1
5,146,640 9/1992 Barton et al. ..... 5/37.1

*Primary Examiner*—Alexander Grosz
*Attorney, Agent, or Firm*—Thomas J. Dodd

[57] ABSTRACT

A convertible sofa-bed which includes a support frame. A seat support is slidably connected to the support frame by a roller and a back support which is pivotally connected to the seat support. The back support includes a hook part which provides for positive connection of the back and seat supports to assure smooth transitional shifting.

6 Claims, 4 Drawing Sheets

CONVERTIBLE SOFA-BED

SUMMARY OF THE INVENTION

This invention relates to sofa-beds and will have special application to a convertible sofa-bed for use in vehicles.

Convertible sofa-beds have been popular items in the recreational vehicle industry for many years. Due to space restrictions, a combination piece of furniture is often most favored. The vast quantities of seat-beds produced for the RV industry have achieved their desired conversion function through linkage connections between the sofa-bed frame, the seat support and the back support. While this has been the standard of the industry for many years, the durability of previous sofa-beds as well as the ease of maintenance has always presented problems.

The sofa-bed of this invention eliminates the problems of the conventional linkage connected sofa-beds. This sofa-bed includes a main support frame which has an angled guide slot. The seat support is slidably connected to the main support frame by a roller which fits into the guide slot. The back support is pivotally connected to the seat support by a hook part and pivot pin. A spring biased link serves to control the shifting movement of the back support and seat support between the sofa and bed positions.

Accordingly it is an object of this invention to provide for a novel convertible sofa-bed.

Another object is to provide for a convertible sofa-bed which is durable and easy to repair and maintain.

Another object is to provide for a convertible sofa-bed which is easily shifted between sofa and bed positions.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to best enable others skilled in the art to follow its teachings.

Figure 1:
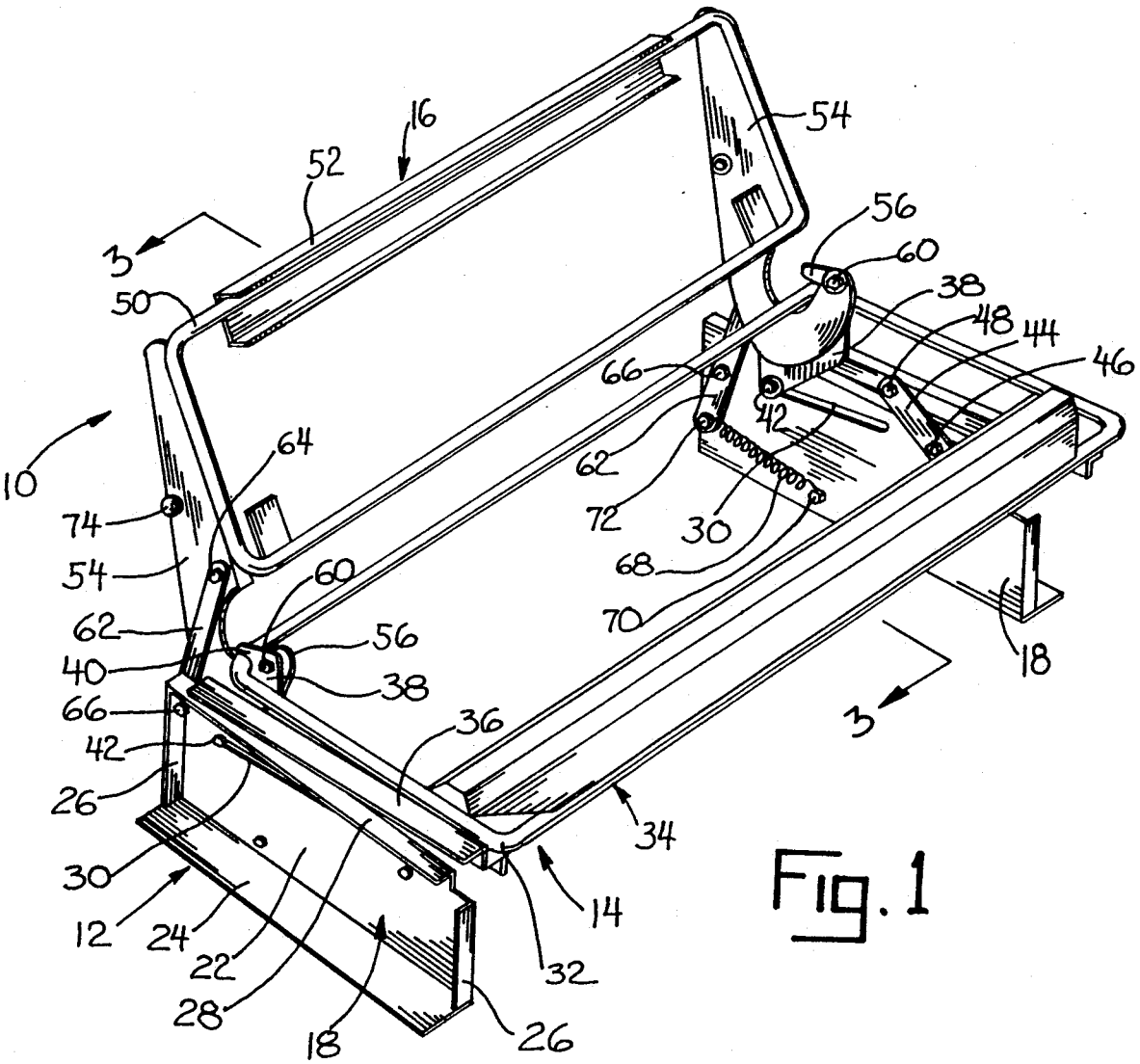
FIG. 1 is aperspective view of the convertible sofa-bed of this invention shown in the sofa position.
Figure 2:
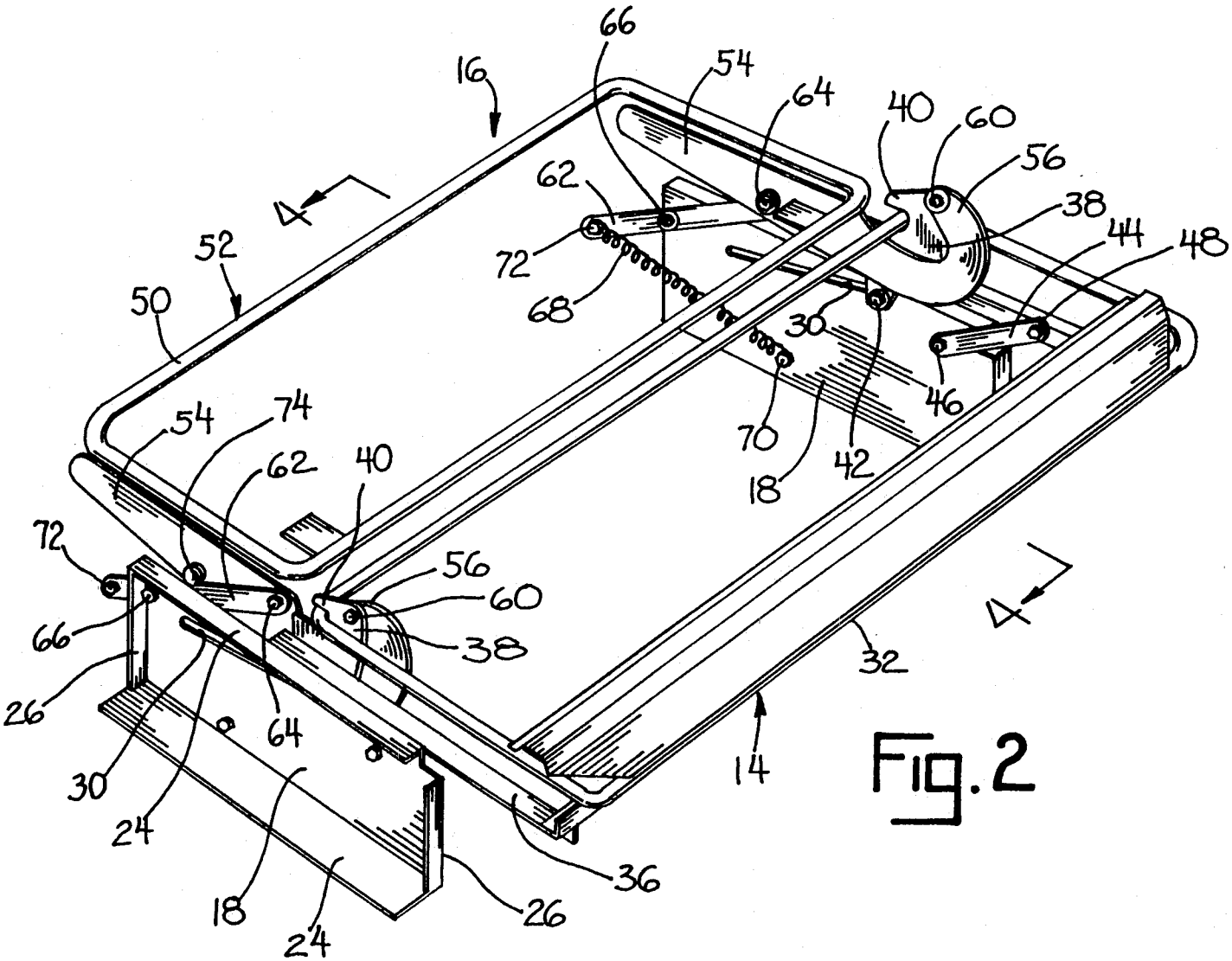
FIG. 2 is a perspective view of the sofa-bed in the bed position.
Figure 3:
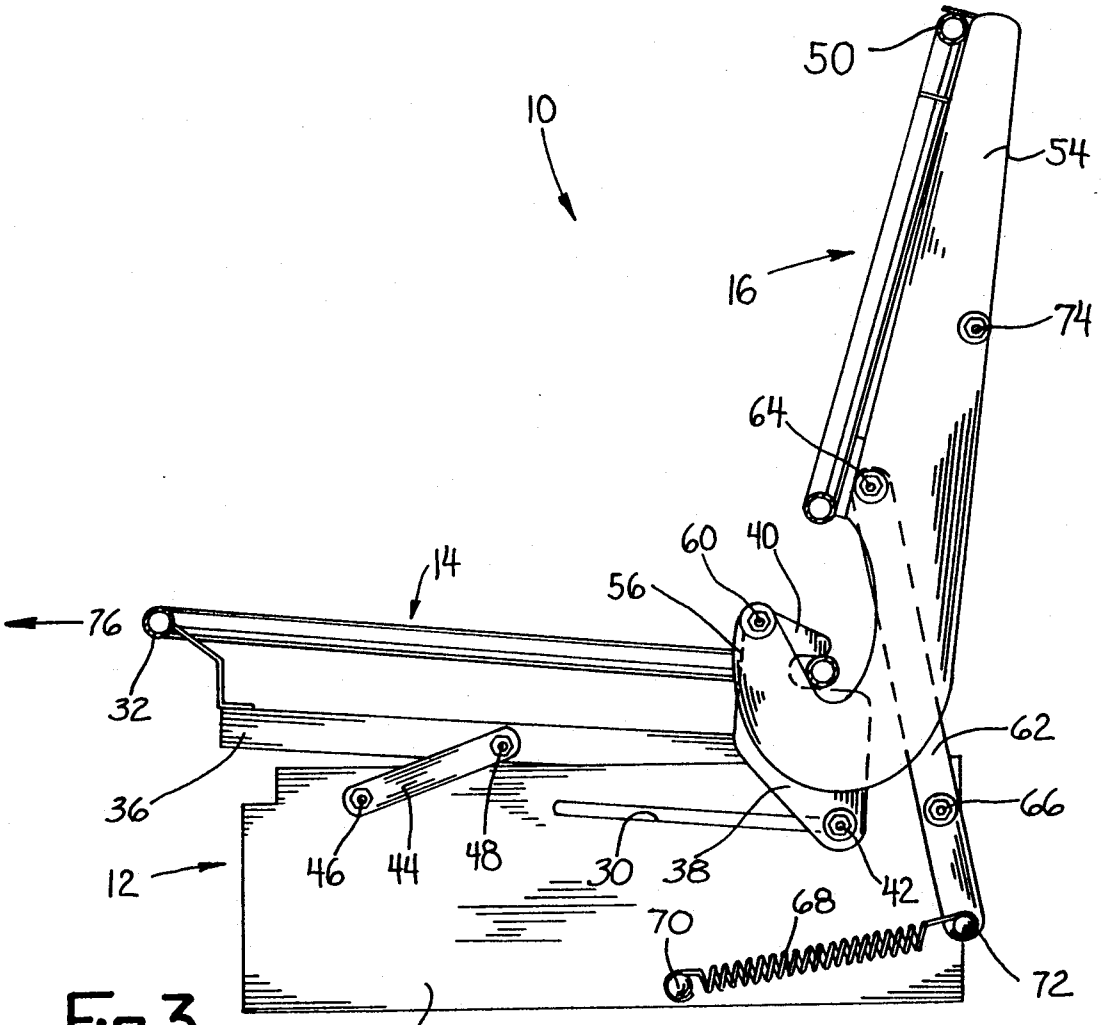
FIG. 3 is a sectional view of the sofa-bed taken along line 3—3 of FIG. 1.
Figure 4:
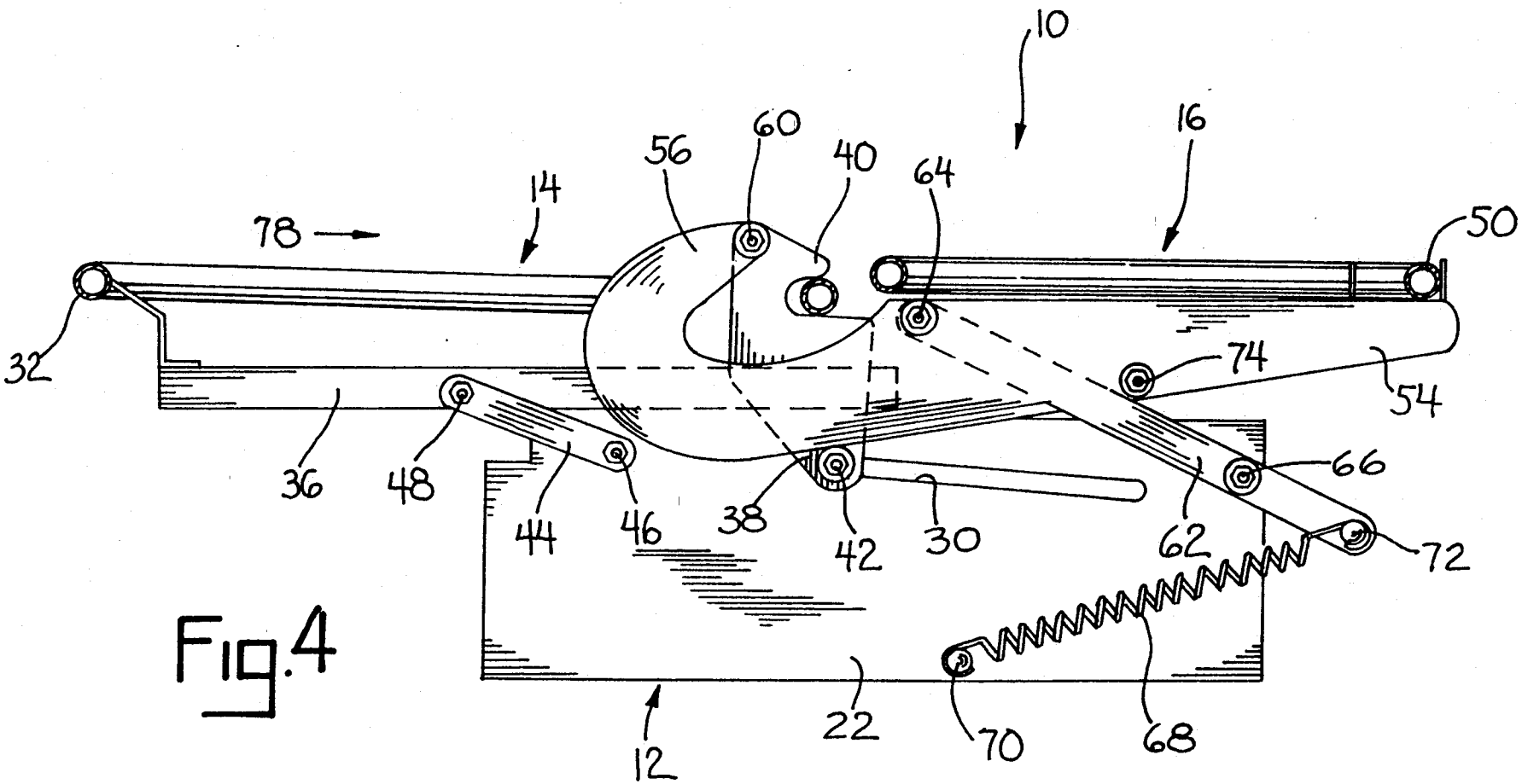
FIG. 4 is a sectional view of the sofa-bed taken along line 4—4 of FIG. 2.

Referring to the drawings, reference numeral 10 generally designates the convertible sofa-bed of this invention. Sofa-bed 10 includes generally a main support frame 12, a seat support 14 and a back support 16. Seat support 14 and back support 16 are shiftable relative to main support frame 12 between a seat position, as shown in FIGS. 1 and 3, and a bed position as shown in FIGS. 2 and 4. Sofa-bed 10 is generally constructed for use in limited space vehicles such as vans, travel trailers, motor homes and other recreational vehicles (not shown) but is not limited to such use.

Main support frame 12 includes opposite base members 18 which may be connected as by rails (not shown) to form the main support frame. Each base member 18 includes upright plate 22, base flange 24, end flanges 26 and top flange 28. A slot 30 is defined in each base member 18 and preferably angles slightly upwardly from the rear of the base member to the front as shown.

Seat support 14 includes frame rails 32 interconnected to form a generally one-piece seat support frame 34. Seat support 14 also includes side rails 36 connected to frame 34 and which are supported atop the top flanges 28 of base members 18. A slide bracket 38 is fixedly connected by conventional means to each side rail 36. Each slide bracket 38 includes an integral hook part 40 which partially encloses frame rails 32 as shown. A roller projection 42 extends from each slide bracket 38 into slot 30 and serves as a guide means during shifting movement of seat support 14. An over center link 44 is pivotally connected between each side rail 36 and base member 18 by pivot pins 46, 48 respectively.

Back support 16 as shown includes frame rails 50 interconnected to form a generally one-piece support frame 52. Back support 16 also includes side located brackets 54 connected to frame 52 by conventional means. Each bracket 54 includes a terminal hook part 56 connected as shown to each slide bracket 38 by pivot pin 60. Brackets 54 are connected to base members 18 by link 62 and pivot pins 64, 66 as shown. Spring 68 is connected between each projection 70 of base members 18 and each projection 72 at the lower end of each link 62 as shown. A stop projection 74 extends outwardly of each bracket 54. Both seat support 14 and back support 16 are designed to support cushions (not shown) in a conventional manner.

Sofa-bed 10 is shiftable between the sofa position of FIGS. 1 and 3 and the bed position of FIGS. 2 and 4 as follows. A user grasps seat support 14 near the front edge thereof and pulls on the seat support in the direction of arrow 76. As the seat support 14 is pulled outwardly, frame rail 34 pushes against hook parts 56 of back support brackets 54 to cause pivoting movement of the back support 16 about pivot pin 60. Roller projection 42 rides upwardly and forwardly in guide slot 30 and over center link pivots as shown to guide seat support 14 until it reaches the bed position. Roller projection 42 also acts as a stop member to prevent further pulling of seat support 14 by contacting the terminus of slot 30 (FIG. 4).

Back support 16 pivots about pins 60 during the extension of seat support 14 described above. Links 62 pivot forwardly as shown about pins 64, 66 under the biasing counterinfluence of spring 68 to assure for smooth transitional movement of the back support 16 into the bed position. Movement of back support 16 is halted by stop projections 74 contacting links 62 as shown in FIG. 4.

To return sofa-bed 10 to the seat position, the user lifts up on seat support 14 and pushes in the direction of arrow 78. This effects a reverse pivoting movement of back support 16 under the influence of spring 68 to cause the back support to pivot back towards the sofa position. The tension in spring 68 is sufficient to keep the back support 16 in its upright seat position (FIGS. 1 and 3) yet is easily overcome by the shifting of the seat support 14 above described. It should further be noted that the seat support 14 may be designed for manual shifting, as above described, or may be connected to any of the several power assist devices available to allow for automatic power assisted shifting.

It is understood that the invention is not limited to the details above given, but may be modified within the scope of the following claims.

We claim:

1. In a convertible sofa-bed including a base frame, a seat support shiftable connected to said base frame, and a back support shiftably connected to said seat frame, said seat support and back support shiftable relative to said base frame between a sofa position wherein the back support is upright and a bed position wherein the back support is flat, the improvement wherein said base frame defines an elongated guide slot, said seat support including a projection means slidably positioned in said guide slot, said back support including pivot means for shiftably connecting the back support to the seat support wherein said seat support and back support shift together relative to said base frame between said sofa and bed positions, said back support including a lower hook part, said seat support including a peripheral frame rail contacting said hook part when the seat support is in the sofa position to effect correlative shifting to said seat support and back support towards said bed position.

2. The convertible sofa-bed of claim 1 wherein said seat support includes a slide bracket, said projection means carried by said slide bracket, said pivot means rotatably connected to said slide bracket.

3. The sofa-bed of claim 1, and equalizer means connected between said back support and base frame for regulating shifting movement of said back support towards the bed position by urging the back support towards the upright sofa position.

4. The sofa-bed of claim 3 wherein said equalizer means includes a link having a first end including means pivotally connected to said back support, said link having a second end connected to biasing means for urging the link and back support towards the upright seat position, means for pivotally connecting said link to said base frame between its said first and second ends.

5. The sofa-bed of claim 4 wherein said biasing means is a spring having a first terminus connected to said base frame, and a second terminus connected to said link second end.

6. The sofa-bed of claim 4 and an over center link having a first end including means pivotally connected to said seat support, and a second end including means pivotally connected to said base frame forwardly of said back support.

* * * * *